US008657655B2

(12) United States Patent
Starke et al.

(10) Patent No.: US 8,657,655 B2
(45) Date of Patent: Feb. 25, 2014

(54) DEVICE FOR TRANSFERRING COINS

(75) Inventors: Christian Starke, Paderborn (DE); Thorsten Neumann, Paderborn (DE); Axel Grimm, Steinheim (DE); Stig Goepel, Osten (DE)

(73) Assignees: Wincor Nixdorf International GmbH, Paderborn (DE); Crane Payment Solutions GmbH, Buxtehude (DE)

( * ) Notice: Subject to any disclaimer, the term of this patent is extended or adjusted under 35 U.S.C. 154(b) by 0 days.

(21) Appl. No.: 13/416,151

(22) Filed: Mar. 9, 2012

(65) Prior Publication Data

US 2012/0231720 A1 Sep. 13, 2012

(30) Foreign Application Priority Data

Mar. 10, 2011 (DE) ..... 10 2011 005 383

(51) Int. Cl.
*G07D 1/00* (2006.01)

(52) U.S. Cl.
USPC ..... 453/18; 453/29

(58) Field of Classification Search
USPC ..... 453/18, 1, 2, 29, 30, 32, 58; 194/215, 194/216, 217, 350, 353; 225/1 R, 1 D, 379, 225/384, 133 R; 902/8, 9, 10, 12, 13, 24; 235/1 R, 1 D, 379, 384, 133 R; 414/227, 414/246, 247, 403; 700/213–216, 218, 225, 700/231, 242; 232/1 D, 64; 221/2, 7, 10, 221/154, 174, 185, 191, 282, 287
See application file for complete search history.

(56) References Cited

U.S. PATENT DOCUMENTS 5,469,951 A * 11/1995 Takemoto et al. ..... 194/206
2006/0054456 A1 3/2006 Trennar

FOREIGN PATENT DOCUMENTS

| | | | |
|---|---|---|---|
| DE | 102007002892 | A1 | 7/2008 |
| EP | 1939821 | A1 | 7/2008 |
| WO | 9953452 | A1 | 10/1999 |
| WO | 2004013818 | A1 | 2/2004 |
| WO | 2007091932 | A1 | 8/2007 |

OTHER PUBLICATIONS

European Search Report dated Jun. 14, 2012, Application No. 12 153 637.9.

* cited by examiner

*Primary Examiner* — Mark Beauchaine
(74) *Attorney, Agent, or Firm* — Patent Central LLC; Stephan A. Pendorf

(57) ABSTRACT

A device for the delivery of coins from a coin dispensing station to a mobile supply device or from the mobile supply device to a coin receiving module. The coin reservoir of the mobile supply device is designed such that the coins collected in the coin reservoir are delivered in portions to the coin inlet of the coin receiving module, depending on a supply request. An inventory memory unit is assigned to a control unit. The particular advantage of the device consists in that only one mobile supply device is required for supplying and/or filling a number of coin receiving modules.

8 Claims, 2 Drawing Sheets

DEVICE FOR TRANSFERRING COINS

The invention relates to a device for the delivery of coins from a coin dispensing station to a mobile supply device or from the mobile supply device to a coin receiving module, wherein the mobile supply device has a coin reservoir for the storage of a number of coins to be delivered or received, with a device for the detachable connection of the coin dispensing station to a coin inlet of the mobile supply device and/or with a device for the detachable connection of the mobile supply device to the coin inlet of the coin receiving module, with the mobile supply device being in a coin delivery position, with a control unit for data processing.

The invention furthermore relates to a method for the delivery of coins from a coin dispensing station to a mobile supply device or from the mobile supply device to a coin receiving module, wherein the mobile supply device is brought into a coin delivery position relative to the coin receiving module or to the coin dispensing station.

DE 10 2007 002 892 A1 describes a device for the delivery of coins from a supply cassette to a coin receiving module of a cash station, in which for delivery of the coins the supply cassette can be brought and/or be locked into a fixed coin delivery position in relation to the coin receiving module by means of a device for making a detachable connection (locking or blocking device). By actuating a closing element of the supply cassette in the coin delivery position, an opening can be created, so that the coins stored in a coin reservoir of the supply cassette can be transferred into a coin inlet of the coin receiving module. Since the coin reservoir of the coin supply cassette consists of a single closable space, the enabling of the opening will result in the complete emptying of the supply cassette. The known supply cassette therefore exclusively serves to fill a single coin receiving module.

The object of the present invention is to propose a device and a method for delivery of coins from a coin dispensing station to a mobile supply device and/or from the mobile supply device to a coin receiving module such that a plurality of coin receiving modules can be supplied with coins effectively.

To solve the problem, the device according to the invention in conjunction with the preamble to Claim 1 is characterized in that the coin reservoir of the mobile supply device is designed such that the coins collected in the coin reservoir are delivered in portions to the coin inlet of the coin receiving module, depending on a supply request, and that an inventory memory unit, in which the coin inventories of the mobile supply device and/or of the coin receiving module and/or of the coin dispensing station are stored, is assigned to the control unit.

The particular advantage of the device according to the invention consists in that only one mobile supply device is required for supplying and/or filling a number of coin receiving modules. This consequently reduces the logistical complexity, since, depending on the demand, several coin receiving modules of POS systems will need to be filled just by one single mobile supply device, for example. The fundamental idea of the invention is to design and control a coin reservoir of the mobile supply device such that optionally selected or predetermined portions of coins can be delivered either from a coin dispensing station into the mobile supply device or from the mobile supply device into the coin receiving module, depending on the demand. To ensure audit-proof filling of the coin receiving modules, the current coin inventories are stored in at least one inventory memory unit.

According to a preferred embodiment of the device according to the invention, during the coin delivery between the coin dispensing station and the mobile supply device, on the one hand, and the mobile supply device and the coin receiving module on the other, are assigned to the same control unit, are connected via a communication interface and therefore make possible a data comparison with respect to the current coin inventories in these components. In addition, a request by the operator for the current coin inventory of the mobile supply device makes it easier to decide how many additional coin receiving modules can be filled without having to replenish the mobile supply device again at a coin dispensing station.

According to a further development of the invention, the mobile supply device possesses adjustment means so that a portioned discharge and/or delivery of coins to the coin receiving modules is ensured in each case. For example, the coin reservoir of the mobile supply device can have a supply reservoir and a storage reservoir, which are connected via adjustment means designed as a transfer unit, so that by actuating the transfer unit a group of coins are transferred from the storage reservoir into the supply reservoir. The number of coin portions that can be discharged is determined by the number of storage and/or supply reservoirs.

To solve the problem, the method according to the invention is characterized in that a specified number of coins is delivered depending upon a supply request and that the coin inventory data of the mobile supply device and/or of the coin dispensing station and/or of the coin receiving module are updated at the time of the coin delivery.

The particular advantage of the method according to the invention consists in that the supplying and/or filling of a plurality of coin receiving modules is ensured with little effort by means of a single mobile supply device. Because the coin inventory data of the components involved in the coin delivery are continuously updated, an audit-proof delivery of coins is guaranteed, by means of which the current coin inventories can be determined, and it is also guaranteed that the coin supply is traceable.

According to a preferred embodiment of the method according to the invention, the corresponding inventory memory units of the components involved during the coin delivery are reconciled. If the content of a supply reservoir of the mobile supply device is emptied by delivery to a coin inlet of the coin receiving module, for example, then by counting the coins that were input into the coin receiving module it can be checked whether the coin inventory of the storage reservoir indicated by the inventory data memory of the mobile supply device is correct.

According to a further development of the method according to the invention, the mobile supply device is completely filled with coins when it is connected to a coin dispensing station. Several storage reservoirs of the mobile supply device can be filled with the predetermined number of coins in each case, for example. The mobile supply device therefore possesses an initial coin inventory which makes it possible to fill a plurality of coin receiving modules by the sequential emptying of the coin reservoir or of the storage reservoir. For example, the number of coin receiving modules to be filled can correspond to the number of storage chambers or storage reservoirs of the coin reservoir in the supply cassette.

Further advantages of the invention result from the further sub-claims.

An exemplary embodiment of the invention is discussed in greater detail below by reference to the drawings, which show:

Figure 1:
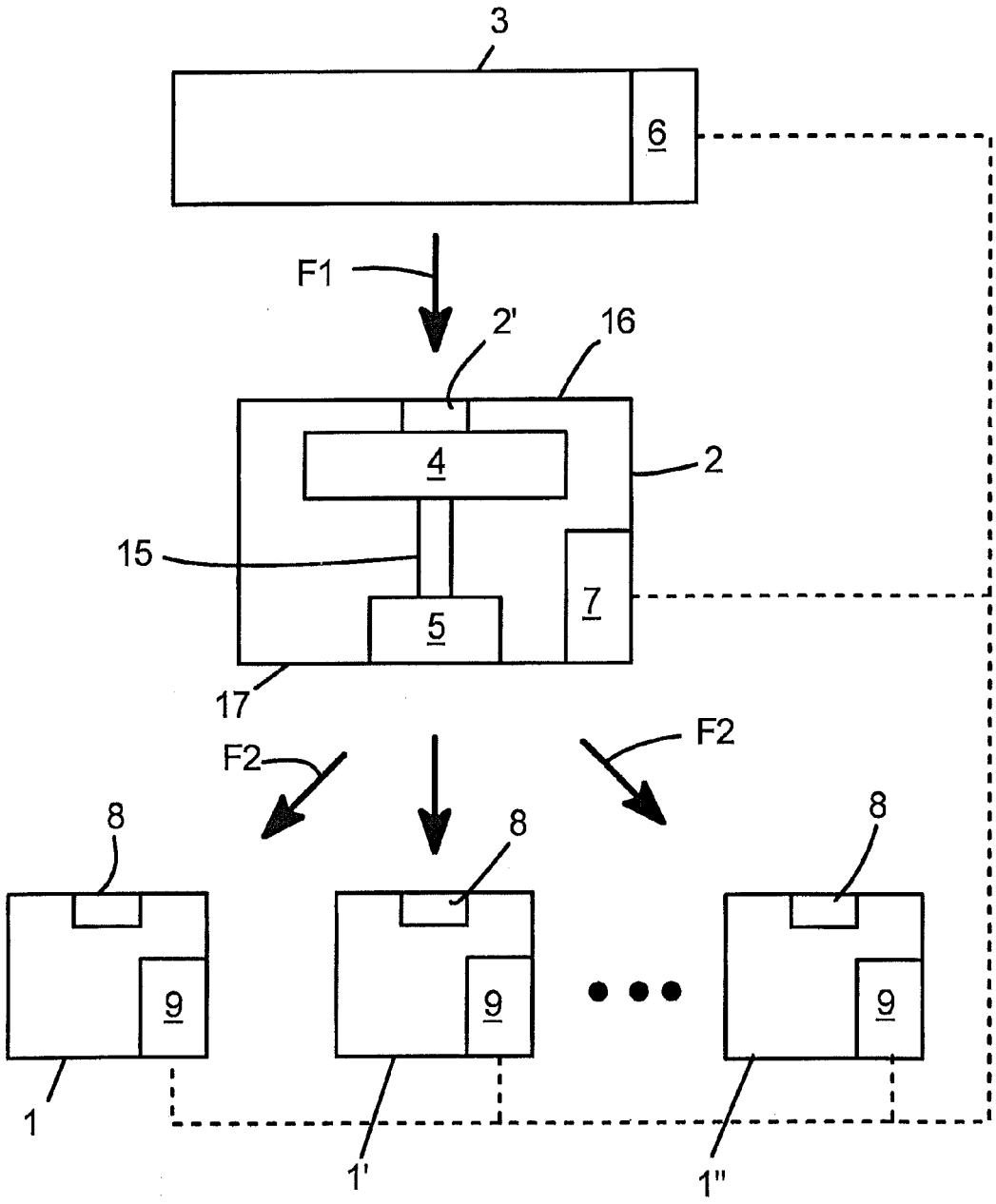
FIG. 1 is a block diagram of a device according to the invention.

The device according to the invention or the system according to the invention is preferably used for the audit-proof supplying of coin receiving modules 1 of POS systems, self-service terminals or suchlike with coins. The coins are conveyed by means of a mobile supply device, i.e. a supply cassette 2, from a central coin dispensing station 3 (cash office) to a number of different coin receiving modules 1, 1', 1". The coin receiving modules 1, 1', 1" can be arranged in a common sales area (supermarket), for example. The coin receiving modules 1, 1', 1" can alternatively also be positioned at different locations/buildings.

The supply cassette 2 comprises a plurality of coin reservoirs 4, 5, which are filled with a predetermined number of coins in each case after connecting the supply cassette 2 to the coin dispensing station 3 by means of a detachable connection device. The supply cassette 2 can have a first coin reservoir 4 designed as a storage reservoir, for example, which in a first coin delivery position is connected to the coin dispensing station 3 via an opening (not shown) to the coin inlet 2', said opening being arranged on the upper side 16 of the supply cassette 2. When the coin inlet opening is in the open position, the predetermined number of coins can be transferred from the coin dispensing station 3 into the storage reservoir 4 and/or into the supply reservoir 5 which is located vertically thereunder and is connected by means of a coupling device 15; see the direction of the arrow F1. When the coupling device is in an open position, the quantity of coins can be transferred directly into the supply reservoir 5. After placing the coupling device 15 into a closed position, the storage unit 4 can be filled by dispensing a further portion of coins (coin quantity). Appropriate control means are provided for placing the coupling device 15 into a closed or an open position.

A control unit 6 of the coin dispensing station 3 is connected by means of a communication interface to a control unit 7 of the supply cassette 2. Within the scope of a coin delivery routine (coin delivery program), which also includes the control of the locking parts of the device (locking device) for the detachable connection of the coin dispensing station 3 to the supply cassette 2 as well as coupling device of the supply cassette 2, the coin inventory data are transferred from the coin dispensing station 3 to the supply cassette 2. The delivered coin inventories are then stored in an inventory data memory unit of the supply cassette 2. The control unit 7 of the supply cassette 2 can be designed as a microcontroller, for example, to which a corresponding program memory and/or inventory data memory is assigned.

For the coin delivery from the supply cassette 2 to one of the coin receiving modules 1, 1', 1" in accordance with the direction of the arrow F2 in FIG. 1, the supply cassette 2 is coupled by means of a known device for the detachable connection of the supply cassette 2 to the coin inlet of the coin receiving module 1, 1', 1" and placed into a fixed and detachable second coin delivery position. In this instance, the supply cassette 2 is located with an underside 17 preferably on an upper side of the coin receiving module 1, 1', 1", so that by opening a closing element of the supply cassette 2, an opening through to a trough-shaped coin feed 8 of the coin receiving module 1, 1', 1" is created. As disclosed in DE 10 2007 002 892 A1, the closing element can be designed as a pivoted flap which, because of its own weight, drops automatically into the trough-shaped coin inlet 8 and therefore opens the path for the coins stored in the supply reservoir 5 to be delivered to the coin receiving module 1, 1', 1". For this purpose, the supply reservoir 5 is arranged vertically below the storage reservoir 4 and is provided with a lower, closable discharge opening. The closing element is arranged on an underside of the supply cassette 2 or the supply reservoir 5. In the second coin delivery position, the supply cassette 2 is preferably attached to the coin receiving module 1, 1', 1" in a locking or latching manner.

In the second coin delivery position, the control unit 7 of the supply cassette 2 is furthermore coupled via a communication interface to a control unit 9 of the coin receiving module 1, 1', 1", in order to guarantee a data comparison between the components 1, 1', 1" and 2 that are connected to each other. In this context, the inventory data of components 1, 1', 1" and 2 are preferably updated or calculated.

Furthermore, protocol data of the coin delivery or identification data of the components 1, 1', 1" and 2 can be determined and exchanged and stored. In this way, different identification data can be allocated to each component 1, 1', 1" and 2, namely to the coin dispensing station 3, the supply cassette 2, and the coin receiving modules 1, 1', 1", so that the storage of the data makes it possible to determine which component has communicated with which other component 1, 1', 1" or 2 and what coin inventory was transferred.

As soon as the supply reservoir 5 is empty and the connection to the coin inlet 8 of the coin receiving module 1, 1', 1" is closed, the supply reservoir 5 is preferably automatically filled with the quantity of coins stored in the storage reservoir 4 by placing the coupling device 15 into an open position, so that the supply reservoir is ready for a further discharge to another coin receiving module 1, 1', 1".

Figure 2:
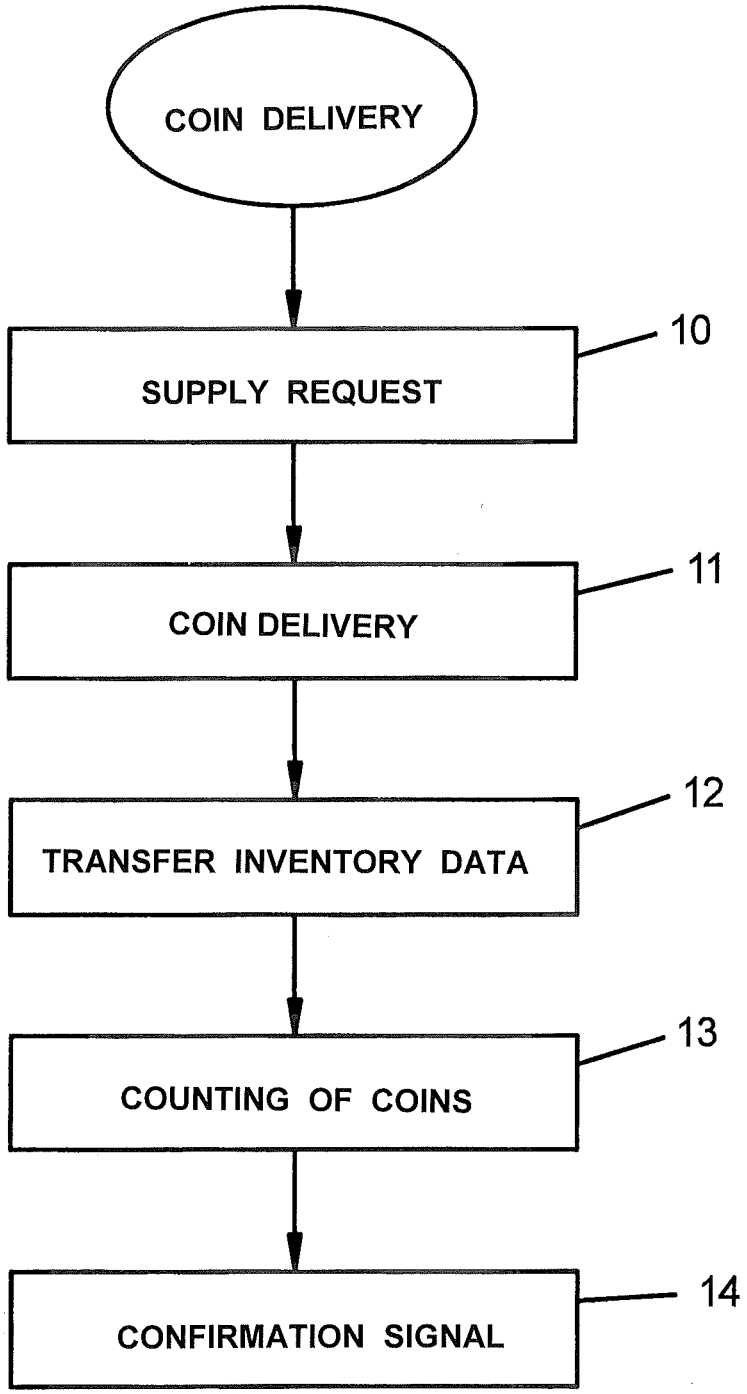
FIG. 2 is a flowchart regarding a coin delivery between a supply cassette and a coin receiving module.

The coin delivery from the supply cassette 2 to one of the coin receiving modules 1, 1', 1" requires that the control unit 7 of the supply cassette 2 receives a supply request 10 for a portioned coin quantity as part of the coin delivery routine. Following a positive check of the supply request to determine whether the supply reservoir 5 contains the required coin quantity, the closing device is triggered to open the passage between the supply reservoir 5 and the coin inlet 8 of the coin receiving module 1, 1', 1". The coin delivery 11 can then occur, with the supply reservoir 5 being emptied completely. Together with the coin delivery 11, the current inventory data of the supply reservoir 5 are transferred to the control unit 9 of the coin receiving module 1, 1', 1", see step 12 in FIG. 2. After delivery of the coin quantity to the coin inlet 8, the delivered coins are counted by means of a counting device of the coin receiving module 1, 1', 1" (step 13), so that it can be checked whether the delivered coin quantity agrees with the requested coin quantity. If agreement is determined, a confirmation signal 14 is sent to the control unit 7 of the supply cassette 2, so that the inventory data memory of the supply cassette 2 is decreased by the number of delivered coins and/or the inventory data memory of the receiving coin receiving module 1, 1', 1" is increased correspondingly. With the confirmation of the coin delivery procedure, the identification data of the components are exchanged via the communication interface. If no agreement was determined, an error message is output, so that an authorized operator can review the coin delivery procedure either immediately or later.

In the present exemplary embodiment, the number of coin reservoirs 4, 5, corresponds to the number of potential coin deliveries to the same or different coin receiving modules 1, 1', 1". The initial coin inventory of the supply cassette 2 corresponds to the total coin quantity that was delivered from the coin dispensing station 3. The coin quantities stored in the respective coin reservoirs 4, 5, are smaller than the initial coin inventory. If the supply cassette 2 has a singling unit, a specific number of coins can be delivered depending upon the supply request, and the supply cassette 2 can have merely a single coin reservoir.

It is self-evident that a defined mechanical and electrical connection exists between the components during the coin delivery. The electrical connection can be established by a cable or plug-and-socket connection or also via a radio link.

The invention claimed is:

1. A mobile supply device for delivery of coins to a coin receiving module having a coin inlet and a control unit, wherein the mobile supply device (2) comprises:

a coin reservoir (4, 5) for the storage of a number of coins to be delivered a device for the detachable connection of the mobile supply device to the coin inlet of the coin receiving module, and a control unit (7), wherein when the mobile supply device (2) is in a coin delivery position relative to a coin receiving module (1, 1', 1") the coin reservoir (4, 5) of the mobile supply device (2) interfaces with the coin inlet (8) of the coin receiving module (1, 1', 1") such that the coins collected in the coin reservoir (4, 5) are delivered to the coin inlet (8) of the coin receiving module (1, 1', 1") in portions depending on a supply request (10) received by the control unit (7) of the mobile supply device (2) from the control unit (9) of the coin receiving module (1, 1', 1"), and wherein the control unit (7) of the mobile supply device (2) is assigned an inventory data memory in which the coin inventory of the mobile supply device (2) is stored.

2. The device according to claim 1, wherein the control unit (7) of the mobile supply device (2), when the mobile supply device (2) is in the coin delivery position, is connected via a communication interface with the control unit (9) of the coin receiving module (1, 1', 1") for reconciling the changing coin inventories resulting from the coin deliveries.

3. The device according to claim 1, wherein when the mobile supply device (2) is in a coin delivery position relative to a coin receiving module (1, 1', 1"), a group of coins is delivered from the coin reservoir (4, 5) of the mobile supply device (2) into the coin inlet (8) of the coin receiving module (1, 1', 1") according to a supply request (10) from the coin receiving module control unit to the mobile supply device control unit.

4. The device according to claim 1, wherein the mobile supply device (2) has at least two coin reservoirs (4, 5).

5. A method for delivery of coins from a mobile supply device to a coin receiving module, comprising:

providing the mobile supply device with at least one coin reservoir for the storage of a number of coins to be delivered, and a control unit in which an inventory of coins in the coin reservoir(s) is stored, providing the coin receiving module with a control unit, bringing the mobile supply device into a coin delivery position relative to the coin receiving module, delivering a predetermined number of coins from the mobile supply device to the coin receiving module in response to a supply request from the coin receiving module control unit to the mobile supply device control unit and updating the inventory of coins in the coin reservoir stored in the control unit of the mobile supply device (2) following the coin delivery.

6. The method according to claim 5, wherein an inventory of coins in the coin reservoir of the coin receiving unit is stored in the control unit of the coin receiving module, and wherein the inventory data stored in the control unit of the mobile supply device (2) is reconciled with the inventory of coins in the coin reservoir of the coin receiving unit during or immediately after the coin delivery.

7. The method according to claim 5, wherein during the coin delivery from the mobile supply device (2) to the coin receiving module (1, 1', 1"):

the stored inventory data of the mobile supply device (2) is read out by a control unit (9) of the coin receiving module (1, 1', 1"), closing means of the mobile supply device (2) are triggered such that a passage in the mobile supply device (2) is opened for delivery of a predetermined number of coins to the coin receiving module (1, 1', 1") according to the supply request (10) from the control unit of the coin receiving module (1, 1', 1"), the coin quantity delivered to the coin receiving module (1, 1', 1") is counted, and then the stored inventory data of the mobile supply device (2) and of the coin receiving module (1, 1', 1") are updated.

8. The method according to claim 5, wherein the mobile supply device (2) and the coin receiving module (1, 1', 1") are assigned identification data, and wherein during the coin delivery between the mobile supply device (2) and the coin receiving module (1, 1', 1"), the identification data of the mobile supply device (2) and of the coin receiving module (1, 1', 1") are alternately transferred and stored.

* * * * *